US007519314B2

(12) United States Patent
Carolan

(10) Patent No.: US 7,519,314 B2
(45) Date of Patent: Apr. 14, 2009

(54) MULTIPLE IOT PHOTORECEPTOR BELT SEAM SYNCHRONIZATION

(75) Inventor: Kevin M. Carolan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 254 days.

(21) Appl. No.: 11/287,685

(22) Filed: Nov. 28, 2005

(65) Prior Publication Data

US 2007/0122193 A1 May 31, 2007

(51) Int. Cl.
*G03G 15/00* (2006.01)
*G03G 15/22* (2006.01)

(52) U.S. Cl. ..... 399/167; 399/306

(58) Field of Classification Search ..... 399/107, 399/162, 167, 299, 301, 306, 396; 347/116
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |

(Continued)

FOREIGN PATENT DOCUMENTS

JP 62210480 A * 9/1987

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Robert Beatty
(74) *Attorney, Agent, or Firm*—Fay Sharpe LLP

(57) ABSTRACT

An imaging system includes a plurality of imaging engines each comprising a photoreceptor belt having a belt seam. A sensor determines a relative position of a first photoreceptor belt of a first one of the imaging engines relative to a second photoreceptor belt seam of a second one of the imaging engines. A controller controls a motor speed of one or more motors driving the photoreceptor belts, wherein an output of the sensor comprises a basis for adjustment of the motor by the controller for relative synchronizing of the first and second belts to avoid skipping pitches in one of the imaging engines due to relative belt seam positions.

9 Claims, 5 Drawing Sheets

U.S. PATENT DOCUMENTS

| | | | | |
|---|---|---|---|---|
| 5,778,377 | A | 7/1998 | Marlin et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 * | 8/2003 | Conrow | 399/364 |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 7,245,856 | B2 * | 7/2007 | Furst et al. | 399/162 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

FOREIGN PATENT DOCUMENTS

| | | | | |
|---|---|---|---|---|
| JP | 11249527 | A | * | 9/1999 |
| JP | 2001117315 | A | * | 4/2001 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

MULTIPLE IOT PHOTORECEPTOR BELT SEAM SYNCHRONIZATION

BACKGROUND

The subject embodiment pertains to the art of printing systems and more particularly printing systems including a plurality of printing engines capable of operating in parallel for parallel or sequential printing of job portions. The preferred embodiments especially relate to a system and method for synchronizing relative operating positions of photoreceptor belts within the printing assembly to avoid undesirable belt seam positioning that can diminish system throughput efficiency.

Printing engines utilizing photoreceptor belts, as opposed to drums, must avoid using the portion of the belt comprising the seam because the seam, if used to store any image data, can mar the output image. In most engine printing systems, paper feeding systems will detect seam position to avoid lining up the paper with the seam. When such avoidance requires delaying the printing operation for the time period of printing a single page, such a wait is referred to as "skipping a pitch" and has a noticeable negative consequence on printing systems throughput efficiency. Adjusting the feed of the paper to assure avoidance of the seam is normally all that is needed in single print engine systems and is usually successful enough so that a pitch is hardly ever skipped.

A special problem exists in multiple print engine systems where a first printing engine (image output terminal or "IOT") can be a presequential feeder to a second IOT. Of importance is that the second IOT be synchronized to the first IOT, i.e., that the second photoreceptor belt seam is synchronized to the first photoreceptor belt seam, to avoid the pitch skipping problems.

When such parallel printing assemblies are initially constructed, it is intended that the respective photoreceptor belts be of the same size (length) and that the motor speed for operating the belts of the IOTs are identical. In such cases, initial calibration is intended to avoid having to adjust the relative positions or operating speeds of the respective engines during operation, or that the feeding system can adjust positions of the documents during input to each engine to accommodate any throughput problems that may arise.

It is an operational objective that there is no delay in paper feed through the system so that throughput can always be maximized. Unfortunately the practical reality is that no two photoreceptor belts are exactly the same size, nor are their respective motors capable of running at exactly the same speed. The respective differences may be quite small, but over time, and the production of many print documents, the respective belts can become so out of synchronization that the conventional paper feed adjustment systems may not be capable of accommodating the phase feed differences and a pitch may have to be skipped.

Accordingly, there is a need for a system capable of monitoring position and phase relationships between respectively associated IOTs, their belts and their seams, so that whatever differences do exist, may be maintained within acceptable ranges to avoid the problems of skipping pitches and throughput delays.

SUMMARY

According to aspects illustrated herein, one disclosed feature of the embodiments is an imaging system including a plurality of imaging engines (IOTs), each comprising a photoreceptor belt having a belt seam. A sensor is provided for determining a relative position of a first photoreceptor belt seam of a first one of the imaging engines relative to a second photoreceptor belt seam of a second one of the imaging engines. A controller controls a motor speed of a motor driving one of the belts, wherein an output of the sensor comprises a basis for an adjustment of the motor speed by the controller for relative synchronizing of the first and second belts for avoiding skipping pitches in an imaging engine due to relatively misaligned belt seam positions.

According to another aspect illustrated herein, a method is provided for selective synchronizing photoreceptor belt seams of a multi-engine printing system to enhance throughput. The method comprises sensing a first position of a first photoreceptor belt of a first imaging engine and sensing a relative position of a second photoreceptor belt to the first position. A difference is determined between the first and second relative positions. Adjustment is selectively made of a motor speed of a motor driving one of the first and second photoreceptor belts to adjust the difference to within an acceptable range to maintain desired throughput efficiency. The difference is preferably determined by measuring a time difference per belt revolution representative of a relative difference in seam position for the belts.

DETAILED DESCRIPTION

Figure 1:
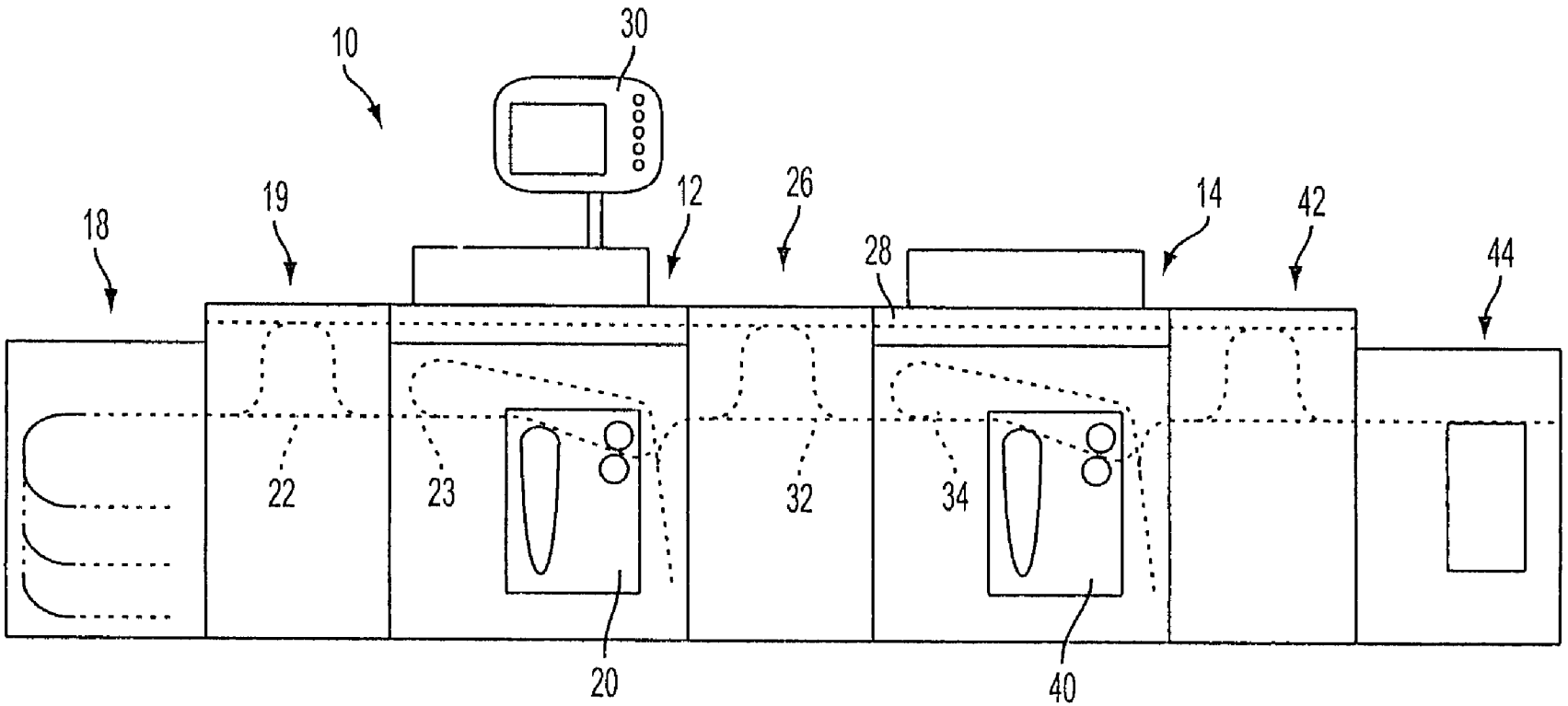
FIG. 1 is an elevated schematic view of a multi-engine printing system.

With reference to FIG. 1, a printing assembly 10 comprises first and second imaging engines or image output terminals 12, 14. The engines are associated in an order to effect sequential or parallel printing of documents through the assembly 10. By "parallel" is meant that while engine 12 is printing one sheet, downstream of the paper path, engine 14 can be concurrently printing another sheet. Sheet feed trays 18 supply sheets to feeder module 19, which in turn feeds marking engine 20 via paper paths 22, 23. After output from the IOT 12, a sheet is received by intermediate transport module 26 where the sheet can be directed to bypass module 28 or through second IOT 14 for further marking. Such an assembly is convenient for marking a first side of a sheet with the first marking engine 12 and the second side of a sheet by second engine 14. The user interface/controller 30 permits the operator to control the job and functions of the IOTs.

It can be appreciated that a document output by the first IOT 12 can be handled by the intermediate transport module 26 to be fed to the second IOT via paper path 32. The sheet would then be directed along second IOT paper path 34 for marking at second marking engine 40. Output transfer module 42 would then handle such a sheet for operator pickup or further transport to a finishing module 44.

In the assembly illustrated in FIG. 1, it is noteworthy that the output of the first IOT 12 comprises a document feeder system to the second IOT 14.

Figure 2:
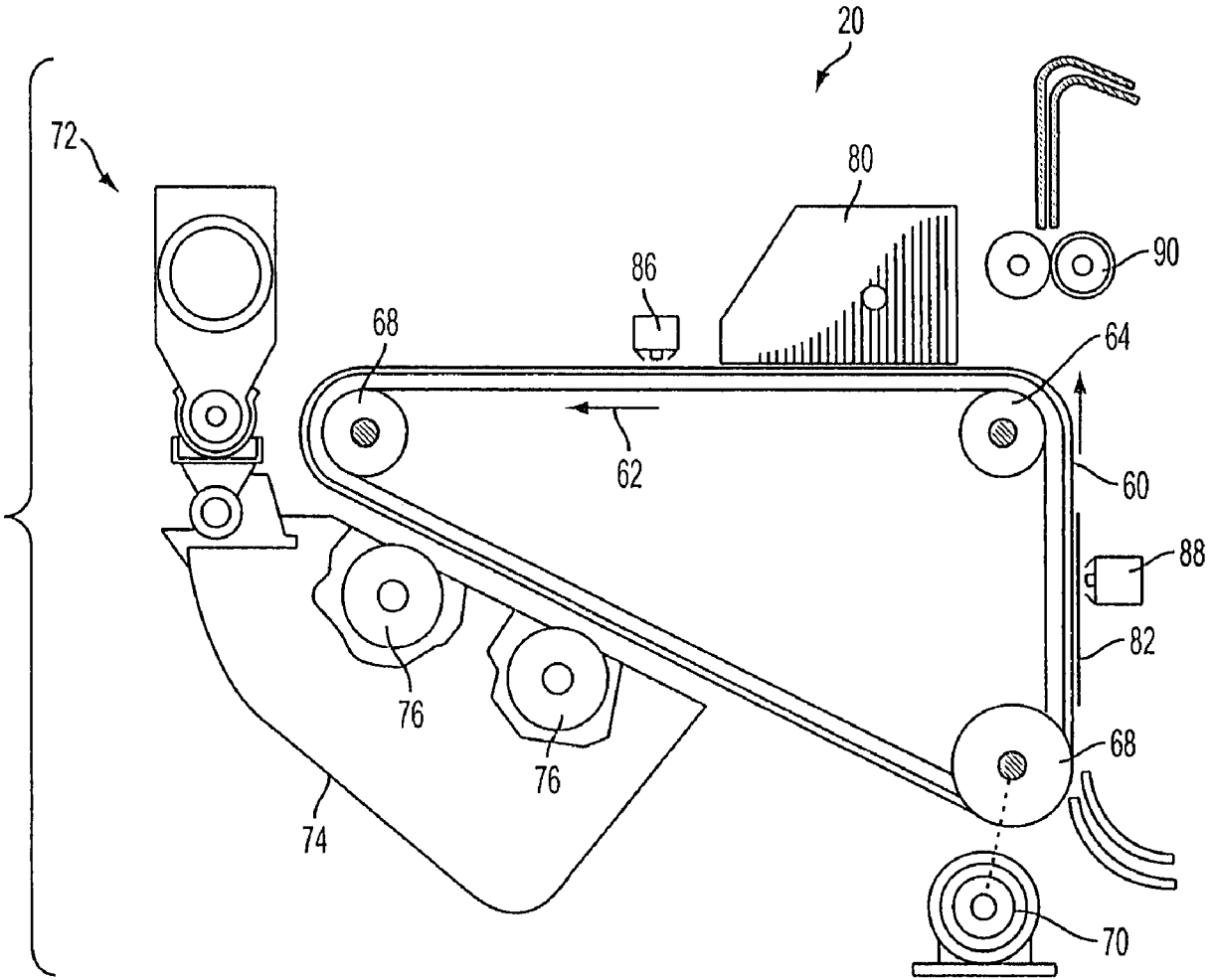
FIG. 2 is an enlarged view of the printing engine itself particularly showing a photoreceptor belt assembly.
Figure 3:
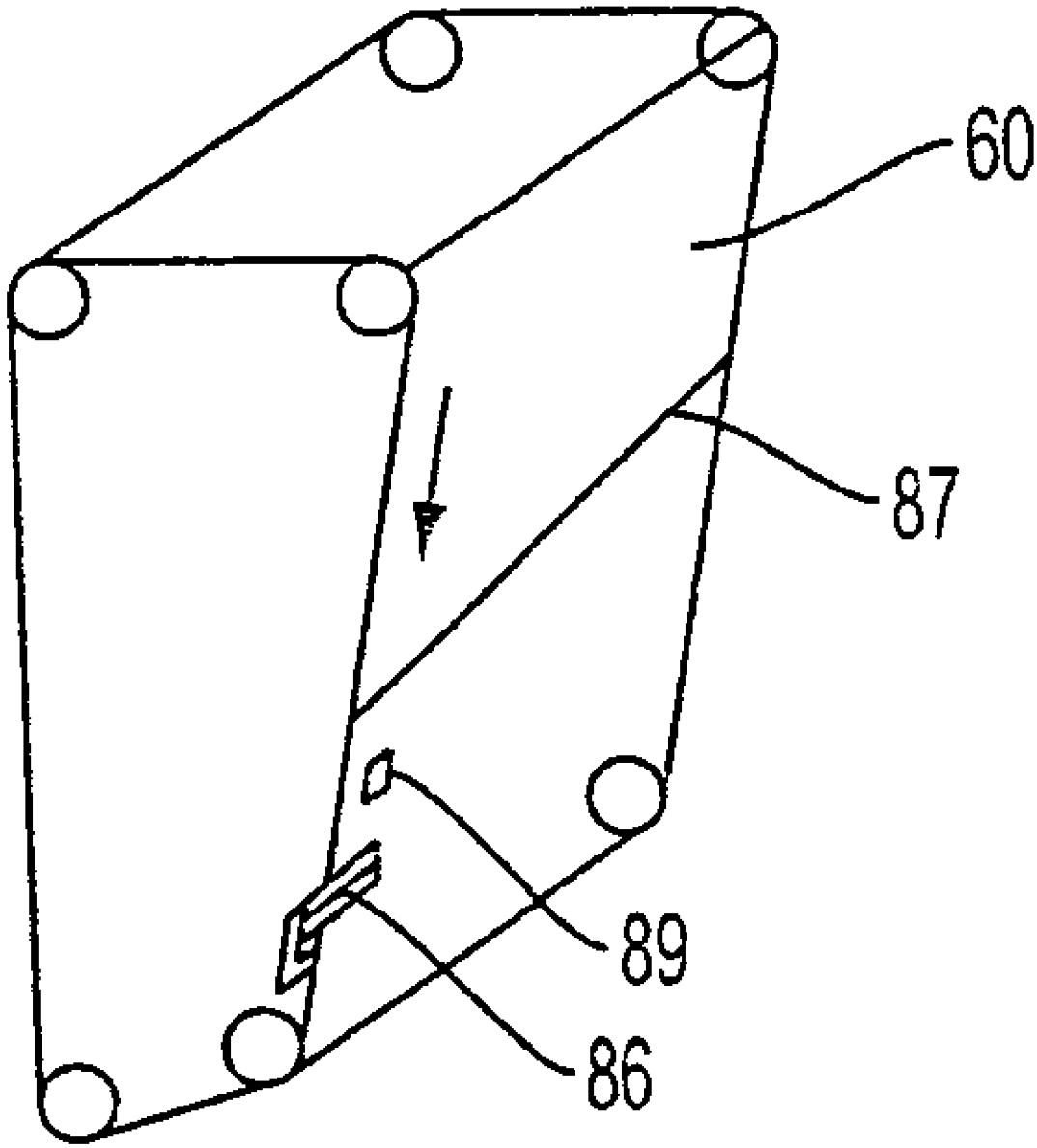
FIG. 3 is an alternative partial view of the photoreceptor belt assembly, showing a seam.

With reference to FIGS. 2 and 3, exemplary embodiments of a marking engine 20 of the kind that may be implemented in either first or second IOTs 12, 14, show a photoreceptor belt 60 having a photoconductive surface deposited on a conductive ground layer. The construction of the subject photoreceptor belt is well known to one of ordinary skill in the art and essentially comprises a photoresponsive material, for example, one comprising a charge generation layer and a transport layer. The conductive layer is typically made from a thin metal layer or metalized polymer film. The belt 60 moves in the direction of the arrow 62 to advance successive portions of the photoconductive surface sequentially through the various processing stations disposed about the path of movement thereof. Belt 60 is entrained about stripping roller 64, tensioning roller 66 and drive roller 68. Drive roller 68 is mounted rotatably in engagement with the belt 60. Motor 70 rotates roller 68 to advance the belt 60 in the direction of the arrow 62. Roller 68 is coupled to motor 70 by suitable means, such as a drive belt or gear assembly (not shown). A toner particle dispenser 72 dispenses toner particles into developer housing 74 where magnetic brushed developer rollers 76 advance developer material into contact with a latent image on the belt 60. Fusing station 90 permanently affixes the transferred powder image to a sheet 82 passing through the assembly. Sensor 86 is disposed to identify some indicia on the belt representative of the position of the belt seam 87. Although many forms of indicia can be used, i.e., markings, reflectors, etc., in one embodiment a belt hole 89 is employed. In addition, sensor 88 can identify a position of the sheet 82 as it passes through the system, typically by identifying its leading edge.

Sensor 86 identifies the position of the photoreceptor belt seam once per revolution and by measurement of the time of passage of the seam past the sensor 86 in both the first IOT 12 and the second IOT 14, and the time that it takes a sheet 82 to be communicated from the first IOT to the second IOT for marking at the second IOT, it is possible to determine a timing window in which there will be no pitch skipping and maximum throughput for the assembly can be, maintained. As noted above, it is conventional to slightly adjust the paper feeding operation. However, over time, differences in dimensions between the belts and operating drives between the two IOTs can relatively arrange the photoreceptor seams 87 of the belts 60 of both IOTs to a position where pitch skipping can occur. By adjusting the speed of either one or both of the photoreceptor belts in the IOTs 12, 14 via adjusting the drive motor 70, an acceptable difference in relative photoreceptor belt seam positioning can be maintained.

Figure 4:
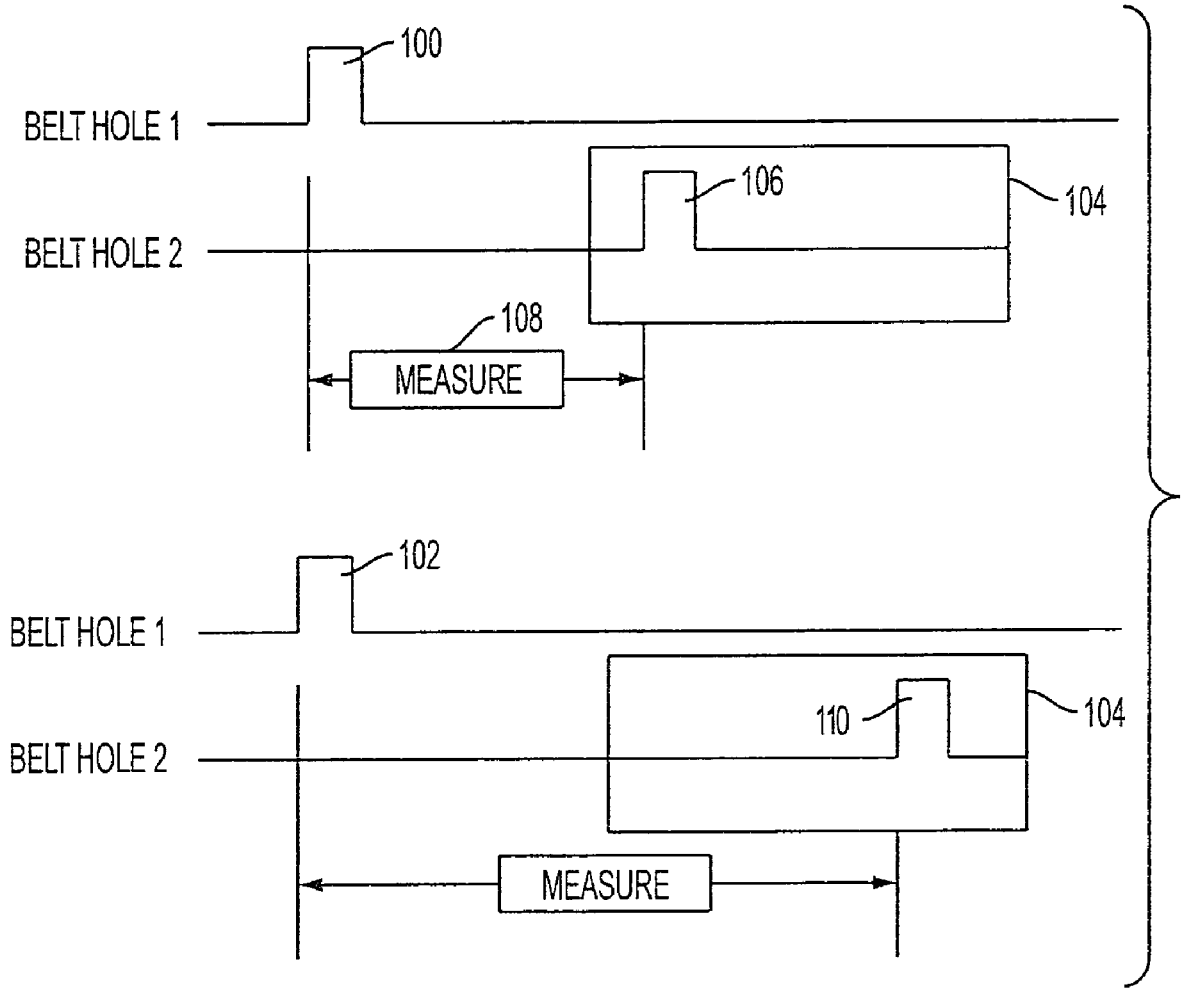
FIG. 4 is a timing diagram showing measurements representative of belt seam relative positions.
Figure 5:
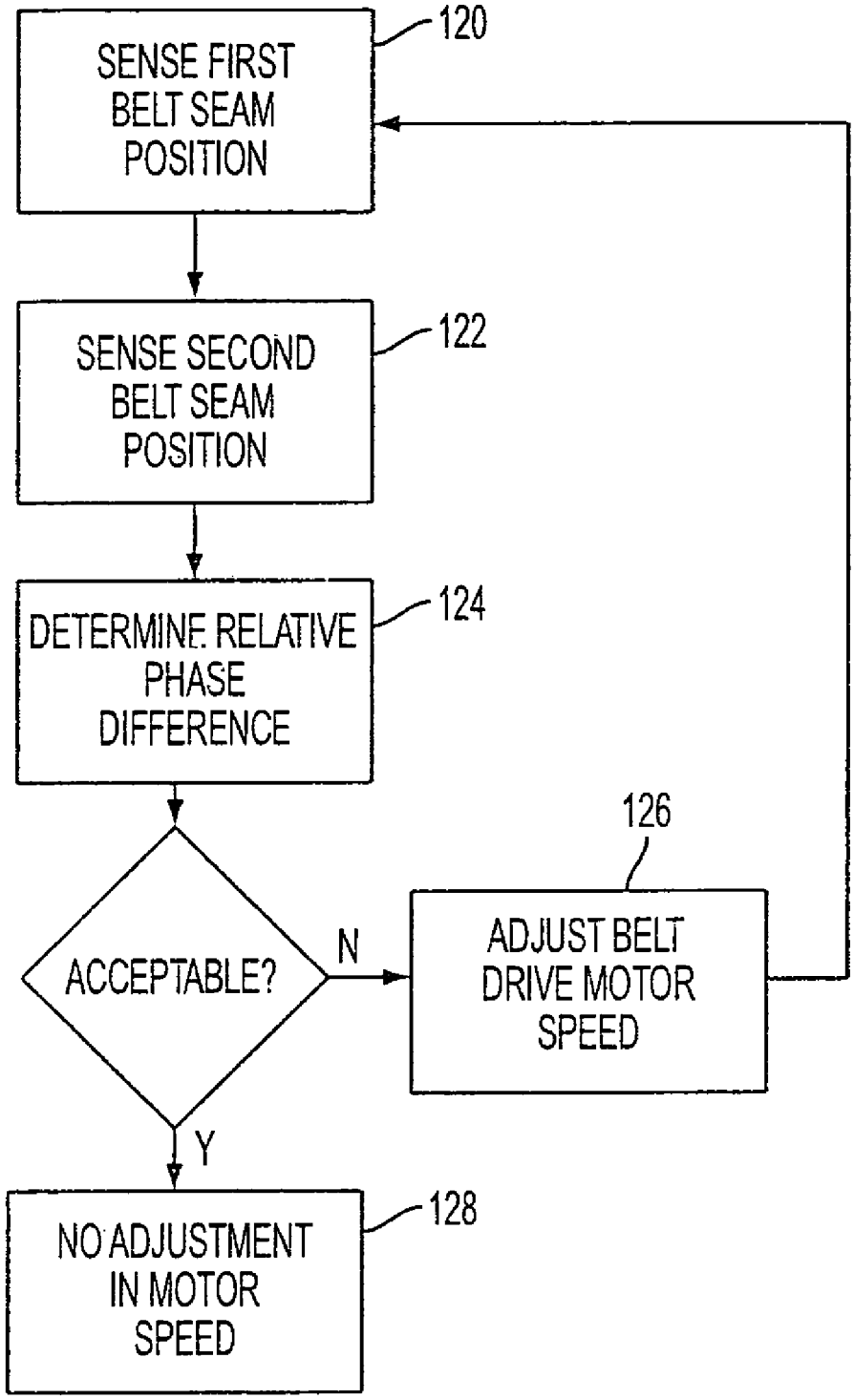
FIG. 5 is a flowchart illustrating process steps of one embodiment of the invention.

With particular references to FIGS. 4 and 5, it can be seen that a belt hole position representative of the first belt seam position is identified 120 by pulse 100, 102. Window 104 comprises a timing range representing an acceptable relative difference in position ("phase difference") between the photoreceptor belt 12 seam and the photoreceptor belt 14 seam. In other words, there is a precise time when the belt hole 1 representing the seam position on the first photoreceptor belt is sensed 120 and the belt hole 2 indicating the photoreceptor belt seam for the second IOT 14 is sensed 122 and represented by pulses 106, 110. The measured time difference between these two sensings is indicative of the relative positions of the first and second seams, respectively of the first and second IOTs. If the difference is determined 124 to be on the low side, as is seen with respect to the measured difference between timings 100 and 106, motor 70 is decreased in speed to correspondingly decrease the speed of the photoreceptor belt in the second IOT 14. The speed adjustment would tend to move the timing difference more to the middle of window 104. If the time difference is measured to be on the high side as is shown between timing measurements 102 and 110, the motor 70 is increased in speed to correspondingly increase the speed of the belt within the second IOT 14 so that the measured time difference would again move towards the middle of window 104. If the relative positioning is acceptably within the window 104, then no adjustment is necessary.

The measured time differences are calculated and the motor speed is adjusted in a program stored in GUI/controller 30. Adjustment in speed can be made to either one of the motors in the IOTs or both motors, to best maintain an acceptable relative position.

The embodied distributed controls system is based on programmability and adjustability. The photoreceptor seam synchronization can be accomplished by exploiting the adjustability of the photoreceptor and the raster output scanner (ROS). The photoreceptor belt velocity can be adjusted 126 to be increased or decreased on one or both of the photoreceptors such that the time between belt seams (as indicated by belt holes) on both photoreceptors can be matched within a small tolerance, i.e., window 104.

The control algorithm for the synchronization updates and compensates once per belt revolution. The algorithm will make a small adjustment to the velocity of one or both of the photoreceptors. There will be a few predefined velocities for each photoreceptor with corresponding ROS polygon velocities that have been setup by a customer service engineer for correct magnification. The change in velocity will be so small that there should not be any image quality defects.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The subject embodiments have been illustrated as printing systems encompassing embodiments in hardware, software, or a combination thereof. By "printing system" as used herein, it is intended to encompass any apparatus, such as digital copier, bookmaking machine, facsimile machine, multifunction machine, etc. which performs a print outputting function for any purpose. The claims are intended to encompass embodiments that print in monochrome or color or handle color image data.

The invention claimed is:

1. A method of selective synchronizing photoreceptor belt seams of a multi-engine printing system to enhance throughput, including:

sensing a first position of a first photoreceptor belt of a first imaging engine being driven by a first motor and sensing a relative position of a second photoreceptor belt being driven by a second motor to the first position;

determining a difference between the first and second relative positions; and, selectively adjusting motor speeds of the first and second motors to adjust the difference to within an acceptable range.

2. The method of claim 1 wherein the sensing comprises detecting an indicia of a seam position for each of the belts.

3. The method of claim 2 wherein the detecting comprises identifying a belt hole for each of the belts.

4. The method of claim 1 wherein this determining comprises measuring a time difference per belt revolution representative of a relative difference in seam position for the belts.

5. The method of claim 4 wherein the measuring comprises detecting an indicia of seam position at a sensor for each belt revolution.

6. The method of claim 4 wherein the selectively adjusting includes increasing the motor speed of the first motor and decreasing the motor speed of the second motor when the measured time difference is less than a preferred time difference.

7. The method of claim 4 wherein the selectively adjusting includes decreasing the motor speed of the first motor and increasing the motor speed of the second motor when the measured time difference is greater than a preferred time difference.

8. The method claim 1 wherein the selectively adjusting comprises synchronizing a timing window representative of relative seam positions between the two belts to preclude skipping a pitch during a printing operation.

9. The method of claim 1 wherein the selective synchronizing is executed during integrated parallel printing or integrated serial printing by the multi-engine printing system.

* * * * *